US005722092A

United States Patent [19]

Borzecki et al.

[11] Patent Number: 5,722,092

[45] Date of Patent: Mar. 3, 1998

[54] PROTECTIVE ARM AND WRIST GUARD

[76] Inventors: Mark Borzecki, 2-106 Glebe Avenue, Ottawa, Ontario, Canada, K1J 2C3; David C. Nielen, 1101 Falaise Road, Nepean, Ontario, Canada, K2E 6P9

[21] Appl. No.: 752,024

[22] Filed: Nov. 19, 1996

[51] Int. Cl.[6] ..... A41D 13/08

[52] U.S. Cl. ..... 2/16; 2/161.1; 602/21

[58] Field of Search ..... 2/16, 19, 20, 159, 2/160, 161.6, 162, 163, 161.1; 602/20, 21, 22, 62, 64; 473/61, 62, 63

[56] References Cited

U.S. PATENT DOCUMENTS

| | | | |
|---|---|---|---|
| 2,318,864 | 5/1943 | Jackson | 602/21 |
| 4,011,596 | 3/1977 | Chang | 2/16 |
| 4,190,902 | 3/1980 | Rhee | 2/16 |
| 4,479,648 | 10/1984 | Alivo, Jr. | 602/21 |
| 4,782,825 | 11/1988 | Lonardo | 602/21 |
| 4,854,310 | 8/1989 | Lee | 602/21 |
| 5,058,576 | 10/1991 | Grim et al. | 602/21 |
| 5,203,766 | 4/1993 | Carter et al. | 602/21 |
| 5,279,545 | 1/1994 | Reese, Sr. | 602/21 |
| 5,313,667 | 5/1994 | Levine | 2/16 |
| 5,526,531 | 6/1996 | Olson et al. | 2/16 |

*Primary Examiner*—C. D. Crowder
*Assistant Examiner*—Larry D. Worrell, Jr.
*Attorney, Agent, or Firm*—Kohn & Associates

[57] ABSTRACT

The present invention is a protective guard for use during sports such as snowboarding. It comprises a substantially rigid dipartite sleeve adapted to receive the distal forearm, wrist and proximal portion of a hand; thumb receiving region at one end of the sleeve to receive and partially surround the base of the thumb of a user and retaining straps to hold the sleeve on the arm of a user.

4 Claims, 2 Drawing Sheets

PROTECTIVE ARM AND WRIST GUARD

FIELD OF THE INVENTION

The present invention relates to the field of arm and wrist protective guards for use during sports and other activities.

BACKGROUND OF THE INVENTION

The increasing popularity of sports such as snowboarding has resulted in an increase in associated injuries. In particular, fractures of the bones in the forearm and wrist such as the radius, ulna and lateral carpal bones are common. Similarly, disruption of the collateral ligaments of the thumb is common. These injuries result partly from the design of snowboards. Snowboards attach to the boots of a user and do not release the boots when the user falls. If a user falls, then the force of the fall will often be absorbed primarily by the user's arms. This type of fall results in serious injuries to unsupported and unprotected forearms and wrists.

One type of protective device is disclosed in U.S. Pat. No. 4,011,596 issued Mar. 15, 1977 to Chang. This patent discloses a forearm and wrist protector for use, in particular, by skate boarders. This protector comprises a rigid, unitary, impact absorbing splint member which overlies the forearm and wrist of the wearer. The protector extends from the elbow to the metacarpophalangeal joint. It may also comprise first and second splint members hinged together at the wrist for flexing of the wrist. A disadvantage of this type of a device is that it is a cumbersome full sleeve arrangement which does not allow the user a full range of movement. The device has a limited range of adjustment and can become uncomfortable and warm with long periods of wear.

Another device is disclosed in U.S. Pat. No. 4,190,902 issued to Rhee on Mar. 4, 1980. This device comprises a longitudinal member made of resilient material such as plastic foam, with one end contoured to cradle the user's elbow and the other end contoured to receive the palm and hand of the wearer. This device provides little protection if the user does not fall flat on the underside of the forearm. It is easily dislocated, thereby drastically reducing protection to the forearm.

Other devices include protectors made from soft pliable material. While these devices may provide some cushioning to the user's forearm as it contacts the ground, they generally do not provide support and little impact absorption. As a result, the user often receives significant injuries including fractures.

There, therefore, is a need for an improved protective guard which is light weight, adjustable to the size of a user's arm, and maintains a proper position thereon.

There is also a need for an improved protective guard which provides support and absorbs impact during a fall to prevent and reduce injuries to the forearm and wrist of a user.

SUMMARY OF THE INVENTION

It is therefore an object of the present invention to overcome the disadvantages of the prior art and provide an effective protective device for the forearm of a user.

The invention therefore provides a protective guard for protecting the forearm and wrist of a user comprising: a substantially rigid sleeve adapted to receive the distal forearm, wrist and proximal portion of the hand of a user; and retaining means to hold said sleeve onto said forearm and wrist.

In another aspect of the present invention, there is provided a protective guard for protecting the forearm and wrist of a user comprising: an elongate sleeve comprised of a first and second member, said sleeve adapted to receive the forearm, wrist and proximal portion of the hand of a user and having a substantially rigid layer; thumb receiving means at one end of said sleeve adapted to receive and partially surround the base of the thumb of a user; and retaining means engaging said first and second member to hold said sleeve onto the forearm of a user.

BRIEF DESCRIPTION OF DRAWINGS

Preferred embodiments of the present invention will now be described and may be better understood when read in conjunction with the following drawings in which.

DETAILED DESCRIPTION OF PREFERRED EMBODIMENT

Figure 2:
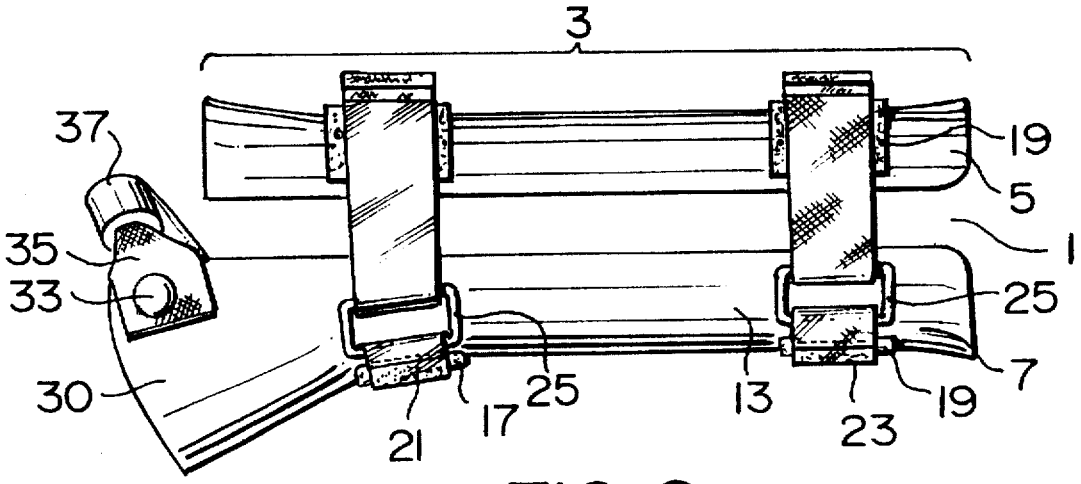
FIG. 2 is a side view of the guard shown in FIG. 1.

With reference to the Figures, there is provided a guard 1 for protecting the forearm and wrist of a user preferably for use during sports such as snowboarding. The guard 1 is comprised of a sleeve 3 having a first and second member 5,7 and straps 21,23 to retain the sleeve 3 on the arm of a user. The sleeve 3 extends from the middle portion of the forearm of a user up to the metacarpal region in the hand of the user. The sleeve 3 is contoured to comfortably receive the distal forearm, wrist, and proximal hand of a user. The first member 5 of the guard 1 may incorporate a portion at either end as shown in FIG. 2. This portion is raised at approximately a 10° angle to the main section of the member for approximately the terminal 2 centimetres of the member. This portion allows for some flexing and movement of the hand and arm of the user. Because the sleeve 3 is made of at least two distinct pieces, the first and second members 5,7, it is easily adjustable to fit different users. The guard 1 is preferably worn over the user's clothing for ease in use and adjustment.

Each member 5,7 has a substantially rigid layer 9 on its outer surface. The substantially rigid layer 9 of the member 5,7 absorbs impact and thereby provides protection to the covered portions of the user's distal forearm, wrist and hand, helping to prevent fractures of the bones in these regions. Preferably, the guard 1 includes a cushioning layer 11 on the inner surface of the guard 1. This layer 11 increases the comfort to a user when wearing the guard 1 and increases the ease of donning and removing the guard 1. It may also provide an impact-absorbing benefit.

Figure 3:
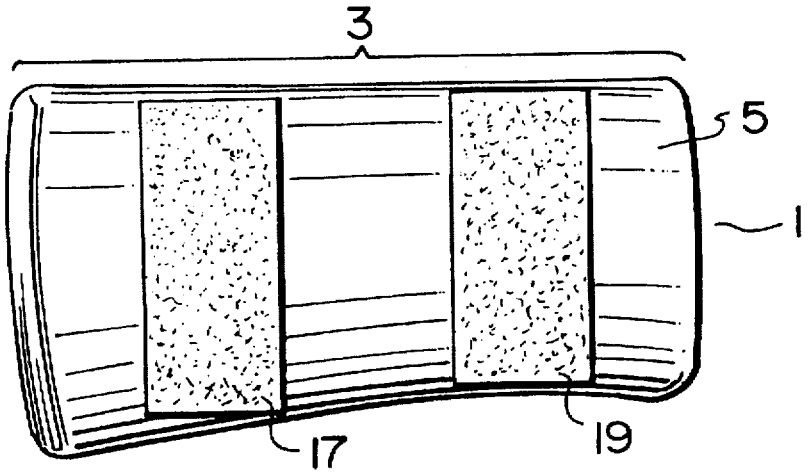
FIG. 3 is a top view of the front piece of the guard shown in FIG. 1.
Figure 4:
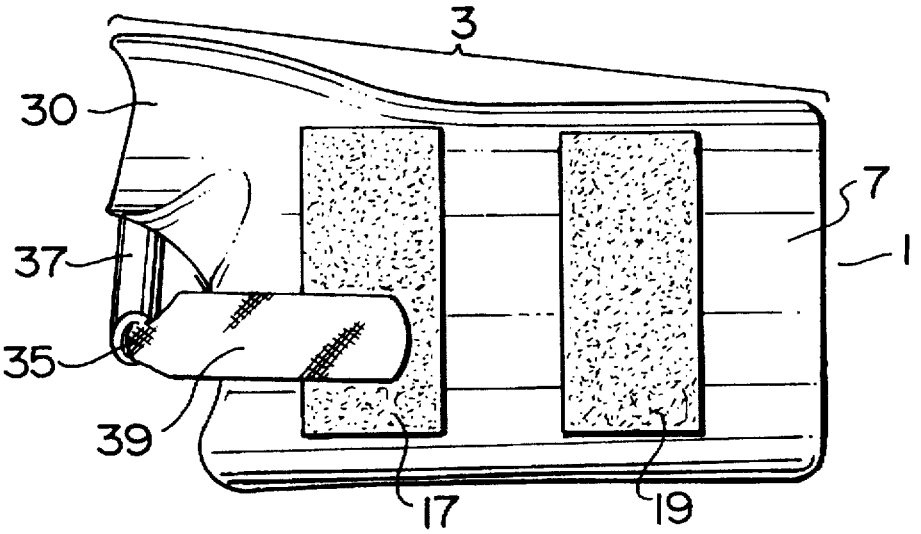
FIG. 4 is a top view of the rear piece of the guard shown in FIG. 1.

The first and second members 5,7 of the sleeve 3 of the guard 1 are attached together surrounding the forearm, wrist and hand of the user by any suitable means. In the embodiment shown in FIGS. 3 and 4, two VELCRO® type bands 17,19 are attached to the outer surface of each of the members 5,7. The bands 17,19 are aligned relatively parallel across the width of the members 5,7. Each band 17,19 has a hook side facing outward. Two long straps 21,23, each having a buckle 25 at one end, encircle the first and second members 5,7, wrap through their buckle 25 and double back onto themselves. Each of these straps 21 has a first side 27 which is a pile layer and a second side 29 which incorporates a hook layer for part of the strap and a pile layer for part of the strap 21,23. The first side 27 of these straps 21,23 interacts with the hook side of the bands 17,19 attached to each of the members 5,7. As the straps 21,23 pass through their own buckle 25 and are folded back on themselves, the hook layer of the second side 29 interacts with the pile layer of the second side 29 thereby fixing the straps 21,23 and members 5,7 in place. As is readily apparent, the hook and pile layers may be reversed. This arrangement of the straps 21,23 increases the strength of the hold of the straps 21,23 around the members 5,7 and allows for easy adjustment of the protective guard 1 on the arm of a user. Each of these straps 21,23 may also have additional material at their terminal ends opposite from the attached buckle or the ends may be doubled back onto themselves. This end provides for a small bulky portion 31 which helps to prevent the end of the strap from slipping out of the buckle while the strap is being adjusted.

A further feature of the guard 1 is the thumb receiving region 30. At one end of the second member 7 is an area contoured similarly to the base of a thumb. When the protective guard 1 is slipped over the forearm of a user, the guard 1 is properly positioned by placing the base of the user's thumb within this region 30.

Figure 1:
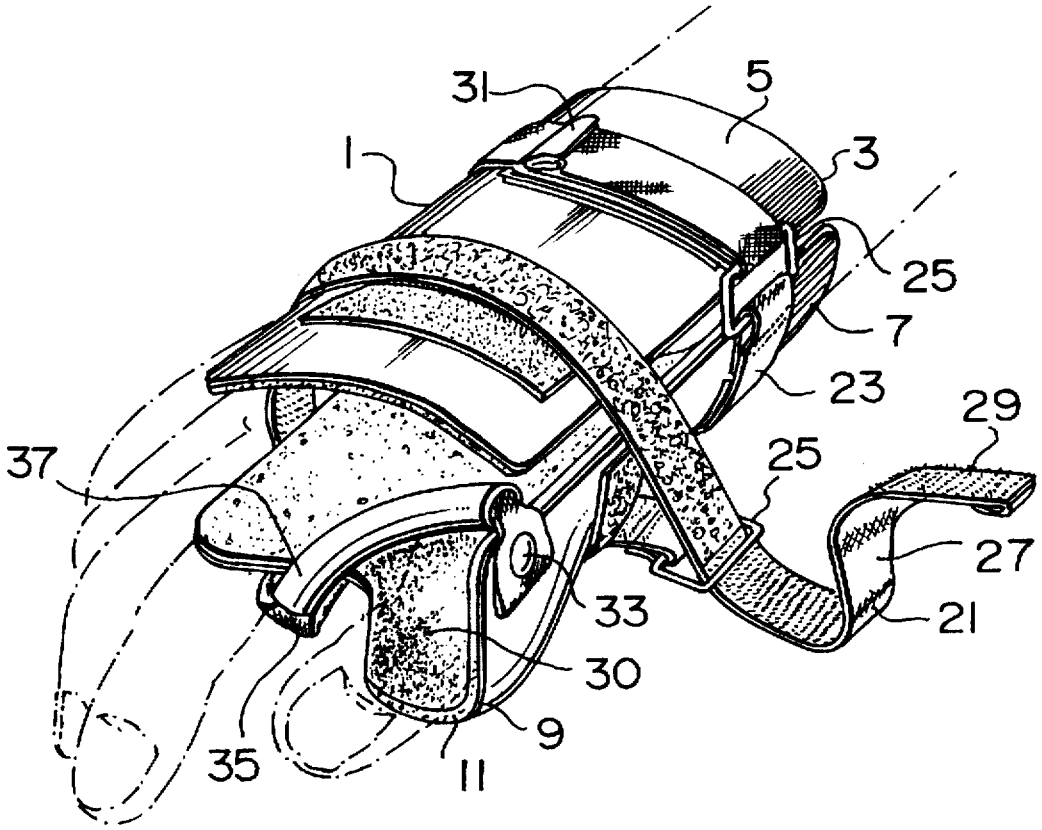
FIG. 1 is a perspective view of one embodiment of the present invention.

The guard 1 may also include a retaining band 35. This band 35 attaches to the outer edge of the thumb receiving region 30 and extends across the thumb receiving region 30 between the user's thumb and palm. The band 35 may be affixed to the rear member 7 in any suitable manner and may be permanently or temporarily affixed at either ends. In the embodiment shown in FIGS. 1, 2 and 3, it is permanently affixed to the outer edge of the thumb receiving region 30 by a permanent connection 33 and, at its other end, it has a VELCRO® type band 39 to removably interact with the band 17 and/or strap 21 on the rear member 7. The retaining band 35 may also have a rubber sleeve 37 or other cover on the portion of the band 35 which passes between a user's thumb and palm. This rubber covering 37 allows for greater comfort of the user and helps to reduce wear and tear on the retaining band 35. The retaining band 35 is used to position the guard 1 in its proper place on the forearm of the user and to retain the guard 1 in place during use.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

We claim:

1. A protective guard for receiving portions of the forearm, wrist, hand, and thumb of a user for protecting same from serious injury and fracture during falls particularly while playing sports, comprising:

a substantially rigid first plate means having a curved shape conforming to the posterior surface of a forearm of the user and adapted to be received thereon, said first plate means extending along the forearm and adjacent the hand of the user;

a substantially rigid second plate means having a curved shape conforming to the shape of an anterior surface of the forearm of the user and adapted to be received thereon extending along the forearm and adjacent the hand of the user, said plate means having a distal end positioned towards the hand of the user and a proximal end positioned away from the hand of the user, said second plate means being independent from said first plate means;

a substantially rigid thumb receiving means on said distal end of said second plate means shaped to conform to the shape of a base of a thumb of the user and adapted to receive the base of the thumb of the user;

retaining means extending across said thumb receiving means for aiding in retaining said plate means in position on the forearm and hand of the user; and strap means adapted to attach said first and second plate means together for adjustably holding said plate means onto the forearm of the user, said strap means including a first strap means positioned near the distal end of said second plate means and a second strap means positioned near the proximal end of said second plate means.

2. The protective guard of claim 1 wherein said retaining means comprises a band having two ends, each end affixed to the thumb receiving means for extending said band across said thumb receiving means.

3. The protective guard of claim 1 or 2 further comprising cushioning means on said first and second plate means.

4. The protective guard of claim 1 wherein said first and second strap means includes a first member affixed to at least one of said first and second plate means and a second member adapted to engage both of said first and said second plate means, said second member removably attachable to said first member for adjusting said first and second plate means on the forearm of the user.

* * * * *